United States Patent [19]

Brachthäuser

[11] 4,323,766

[45] Apr. 6, 1982

[54] DIAGRAM ANALYZING DEVICE WITH TABLE OF EVENTS FOR COMBINED INTERPRETATION OF PLURAL CURVES

[76] Inventor: Norbert Brachthäuser, Rennbahnstrasse 38, 6000 Frankfurt am Main 71, Fed. Rep. of Germany

[21] Appl. No.: 75,950

[22] Filed: Sep. 17, 1979

[51] Int. Cl.[3] ..... G06C 3/00

[52] U.S. Cl. ..... 235/89 R; 235/70 A

[58] Field of Search ..... 235/85 R, 89 R, 85 F, 235/85 C, 88 F, 88 M, 70 A, 89 A, 61 B, 61 D; 273/148 R; 283/34

[56] References Cited

U.S. PATENT DOCUMENTS

| | | | |
|---|---|---|---|
| 2,219,429 | 10/1940 | Osterberg | 235/61 B |
| 3,141,610 | 7/1964 | Jones | 235/61 D |
| 4,027,884 | 6/1977 | Oakley | 273/148 R |
| 4,122,994 | 10/1978 | McReynolds et al. | 235/89 R |

*Primary Examiner*—L. T. Hix
*Assistant Examiner*—Benjamin R. Fuller
*Attorney, Agent, or Firm*—Larson and Taylor

[57] ABSTRACT

A diagram analyzing device is provided which is particularly useful in simultaneous interpretation of a plurality curves representing economic data. The curves are drawn to a common scale and provided on transparent sheets so that they can be superimposed one on the other, two or more at a time. A transparent calculating ruler used in association with the curves enables a user to analyze the data presented in the curves, i.e., to make calculations using the data, and to determine the interrelationships between different sets of data, as well to discern trends and rates of growth. A table of events used in conjunction with the curves enables the data to be interpreted in light of events taking place in the economic world which are thought to influence this data. The calculating ruler contains two different logarithmic scales along the longitudinal edges thereof, with the number "1" providing a baseline for each scale, together with a plurality of time scales across the width thereof.

16 Claims, 6 Drawing Figures

DIAGRAM ANALYZING DEVICE WITH TABLE OF EVENTS FOR COMBINED INTERPRETATION OF PLURAL CURVES

FIELD OF INVENTION

The invention relates to a diagram analyzing device with a table of events for integrated (combined) interpretation of plural curves, especially for use in connection with economic data.

BACKGROUND OF THE INVENTION

The quality of the control over economic processes depends, among other factors, on the information received relative to the economic guiding forces affecting the behavior of the economic system as well as the effects of the guiding forces themselves together with outside or foreign measures (events), and the ability to absorb and analyze this information quickly. Rather precise information concerning such facts may be obtained from a time sequence of relevant measuring data (for example, the amount of turnover and the stock of finished goods on hand), which data may be obtained from appropriate data banks. Any analysis should take into consideration not only the original data but also the rate of growth of the data and the relationships between various sets of data. As a result of these further considerations, the volume of data, which is very large in any event, is further multiplied. The problem dealt with by the present invention concerns the rapid transfer of relevant portions of very large quantities of information or data at a speed and in a form so as to permit the information to be readily digested and analyzed.

In order to make the analysis of large quantities of data easier, such data are conventionally arranged in tables and are displayed visually using suitable diagrams i.e., charts, graphs and the like. Because the relevant data is presented in different formats using different scales, determination of the underlying economic guiding forces requires that the data always be converted to a selected common scale or frame of reference prior to reading and intepretation thereof. This requires considerable time which is not usually available or can not be made available. Often growth rates and relationships between various data are also shown as auxiliary curves in further diagrams and therefore limit the number of curves for the original measuring values which are reproducible on one sheet. Whenever one wishes to investigate such growth rates and relationships without such auxiliary curves, one must go back to the original tables, locate the appropriate measurement data, and use these data to calculate the desired data with the aid of slide rules or table calculators. Such an approach is obviously time consuming and expensive.

Measures taken by the government, or by others, as well as events which are expected to have some effect on the overall federal economic statistics, are published by various agencies. It is very cumbersome and time consuming undertaking to study all of this information, particularly in the appropriate time sequence. One reason for this is that the method of presentation of this information not adjusted relative to a common base.

Recent efforts in this field to reduce the complexity of the task of intepretation of the available data concern the use of simple logarithmic unit yardsticks with 24 mm/year scale. In the articles "Continuous Observation of the Receipts of Orders-Share of the Market in the Case of Capital Goods", New Business Administration, No. 4, 1966, p. 101–102 and "Method of the Process Analysis", special reprint of the "Rationalization Kuratorium", Frankfurt, 1974, an examination is provided of how the growth rates and relationships referred may be determined and read by longitudinal takeups and parallel shiftings. This method is only applicable when complete logarithmic scale divisions are available. Such an addition results in increased expenditure in the case of computer drawings and is generally undesirable from this standpoint. Moreover, calculations which are combined with readings can be only carried out with great difficulty using this approach.

SUMMARY OF THE INVENTION

In accordance with the invention, a handy and easily producible diagram analyzing device is provided which, in one aspect, makes it possible to provide appropriate orientation and analysis of large amounts of numerical and verbal data concerning development processes, based on the fact that the eye is capable of rapidly reading the overall information presented in its appropriate time sequence. At the same time, provision is made for simultaneously reading as many references to relevant events as is possible. In another aspect, the reader is afforded the possibility of recalculating and directly reading numerical data such as measuring values, growth rates and other relationships between data that are of interest to him.

The present invention achieves these objectives through the provision of by a diagram analyzing device with an associated table of events, which device comprises a rectangular calculating ruler readily producible from transparent material, one of more diagram carriers and one or more tables of events. These components are combined with one another in relation to the pertinent analysis and control requirements and are usable together because of a simple logrithmic unit yardstick adapted for the spacing between printed lines employed on the components.

The diagrams of diagram analysing device of the invention provide the reader with a survey of the data for measuring values, growth rates and relationships presented in a uniform analog format which the eye is capable of absorbing relatively quickly. Through the use of transparent diagram sheets the number of surveyable and combinable developments may be multiplied by a simple superimposition of one sheet on the other The so-called "tables of events" referred to above contain verbal and numerical references to events and measures which may and/or should influence the course of developments in the area of interest. Since the distance between the lines of the table of events coincides with the divisions of the scale of the time axis of a "unit yardstick" according to the invention, the eye will easily recognize temporal connections of developments and the preceding events. The calculating ruler, when used in combination with the curves with same reference or base enable the reader employ the ruler as a slide rule so as to, for example, calculate various relationships between the data. Additionally, growth rates can also be determined. The calculating ruler thus permits the direct conversion of analog values into numerical data and thus provides for quantification of the effects of measures taken and events which have occured.

The invention provides a number of advantages over the prior art. For example through the selection of the suitable unit yardstick (frame of reference), diagrams and tables of events may be combined such that the eyes of the observer will be able to survey them simultaneously and compare one with the other. As a result of this, the connections between cause and effect become readily apparent and analyzable. Further, the calculating ruler enables the elimination of the presentation of the simple logarithmic raster associated with the prior art while nevertheless providing for numerical reading of analog values of interest. As a further result, the drawing, by machine, of the diagrams used (e.g. by plotters) is accelerated and the reading per longitudinal scan and parallel shifting is reduced. In addition, readers no longer have to refer back to the basic data tables. The calculating ruler also permits recalculations with the curves in the unit yardstick as with a conventional slide rule. As a result of this, readers are spared the time normally required to transfer work in calculating machines with all the risk of error in the case of the required recalculations. Moreover, and more generally, as a result of the easier and accelerated reception of information, the control over the operation of an enterprise may be improved.

Other features and advantages of the invention will be set forth in, or apparent from, the detailed description of a preferred embodiment set forth hereinbelow.

DESCRIPTION OF THE PREFERRED EMBODIMENTS

Figure 1:
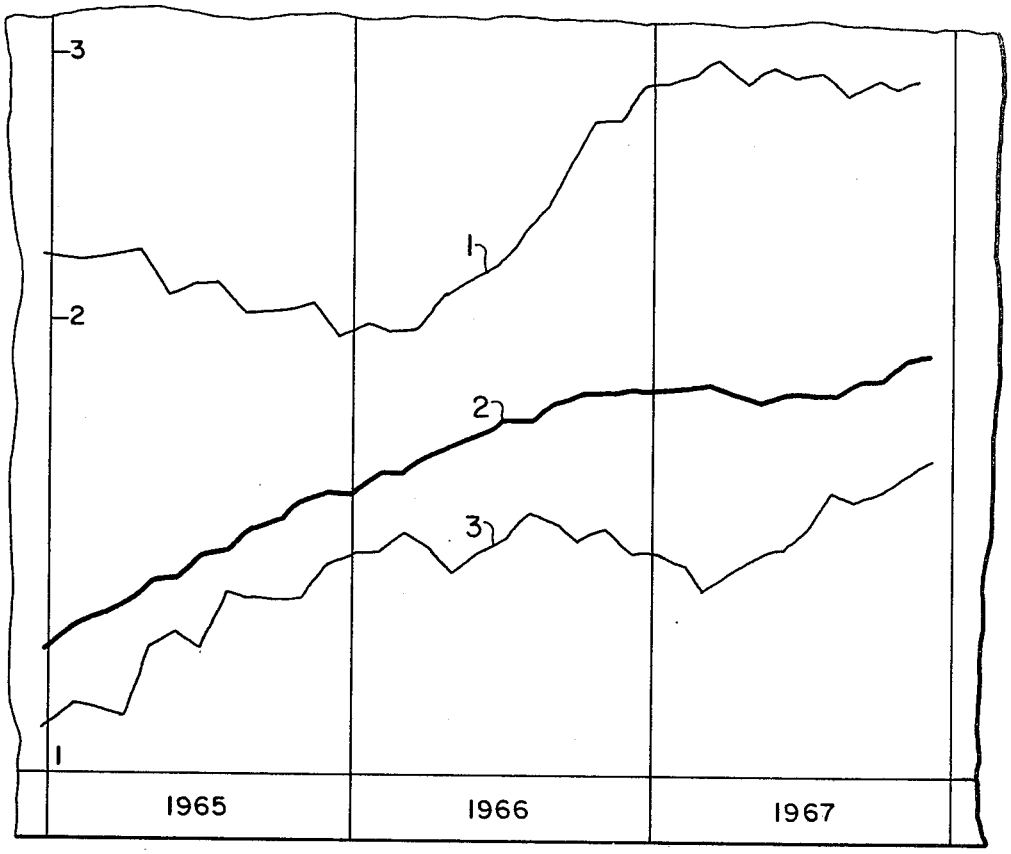
FIG. 1 is composite diagram showing three exemplary curves superimposed on one another and referenced to the same time scale.

As used hereinafter, the term "unit yardstick" is intended to refer to an axial system of coordinates with simple logarithmic divisions. These divisions are arranged longitudinally for use in conjunction with a series of curves of any arbitrary number. The longitudinal arrangement of the logarithmic scale is governed by considerations of expedience, particularly with respect to the availability of space in document and paper formats. Referring to FIG. 1, a composite diagram showing three curves wherein, in accordance unit yardstick referred to above:

lg 10=250 mm; and 1 year=50.8 mm (2")

The three curves illustrated are exemplary, with curve 1 representing "the stock of finished goods" (x $10^3$ TDM/M), curve 2 representing "market developments" (x $10^4$ TDM/M) and curve 3 representing "our own turnover" (x $10^3$ TDM/M). All of the curves concern the same product or group of products and represent sliding 12-month mean values. Although a composite of three curves is shown, it is to be understood that the curves may be drawn individually on one or more transparent sheets so that the composite curves represented in FIG. 1 can be reproduced by simply laying the transparencies one on top of the other.

Figure 2:
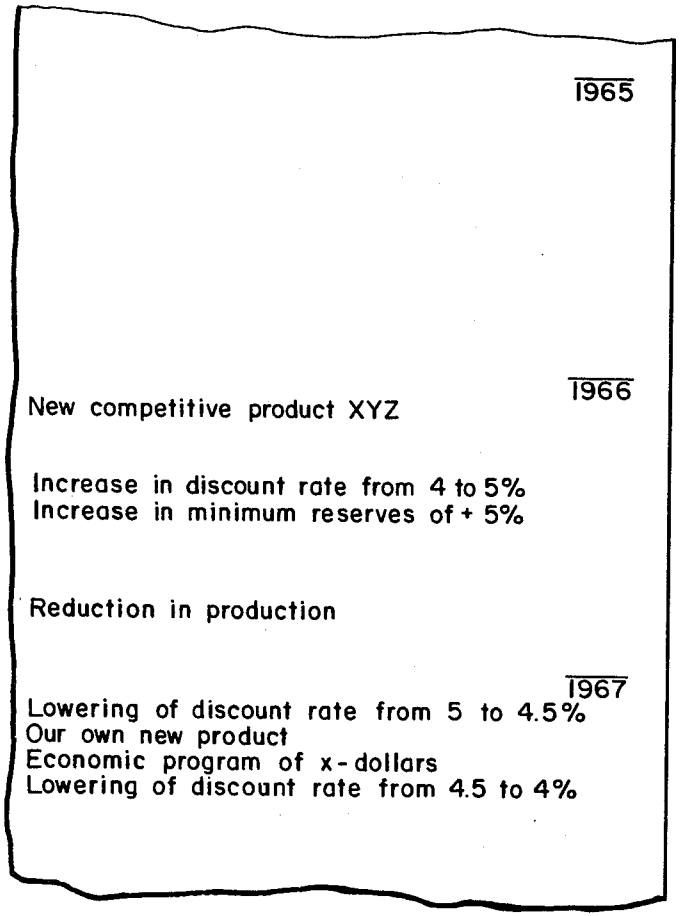
FIG. 2 is a table of events which sets forth exemplary events and which is referenced to the same time scale as provided in FIG. 1.

Referring to FIG. 2, a table of pertinent events is provided. With the layout illustrated, one line is available for each month of the relevant calendar year. The "events" set forth in FIG. 2, are examples of events which might be of interest in charting economic developments.

Figure 3:
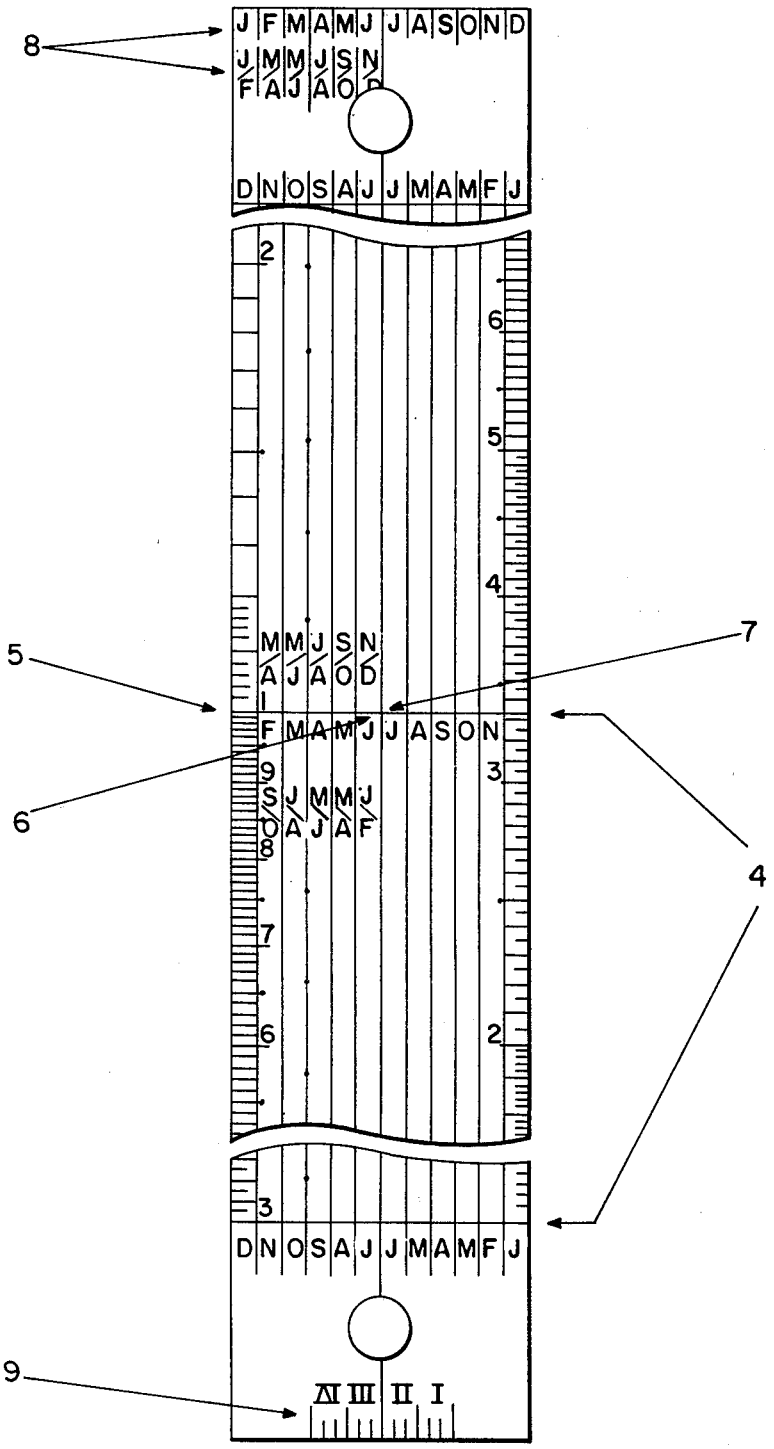
FIG. 3 is a plan view of a calculation ruler in accordance with a preferred embodiment of the invention.

Referring to FIG. 3, a calculating ruler is shown which is constructed in accordance with a preferred embodiment. In an exemplary case, the ruler has an overall width of 50.8 mm/year. At the two longitudinal edges thereof, logarithmic scales are provided. In the case of the left-hand scale, the position of the baseline or reference line for the numeral "1" indicated at 4 and is disposed in the middle of the ruler, while, in the case of right-hand scale, the corresponding baseline 4 is located at the bottom of the ruler. The entire width of the ruler contains a time scale divided into 12 months. The initial letters of the months are set out from left to right as well as from right to left. It will be understood that the ruler of the invention may also be used with other "unit yardsticks". In the illustrated embodiment, one time scale begins on the left-hand edge, indicated at 5, and terminates, in the case of the scale of 50.8 mm/year, in middle of the ruler (indicated at 6) and, the case of 24 mm/year, at a correspondingly placed mark of the ruler (indicated at 7). Additional time scales may be provided at the narrow edges of the ruler as indicated at 8 or 9. It will be appreciated that additional variations in the scales shown, such as reciprocal logartithmic scales and millimeter scales, can also be used.

Figure 4:
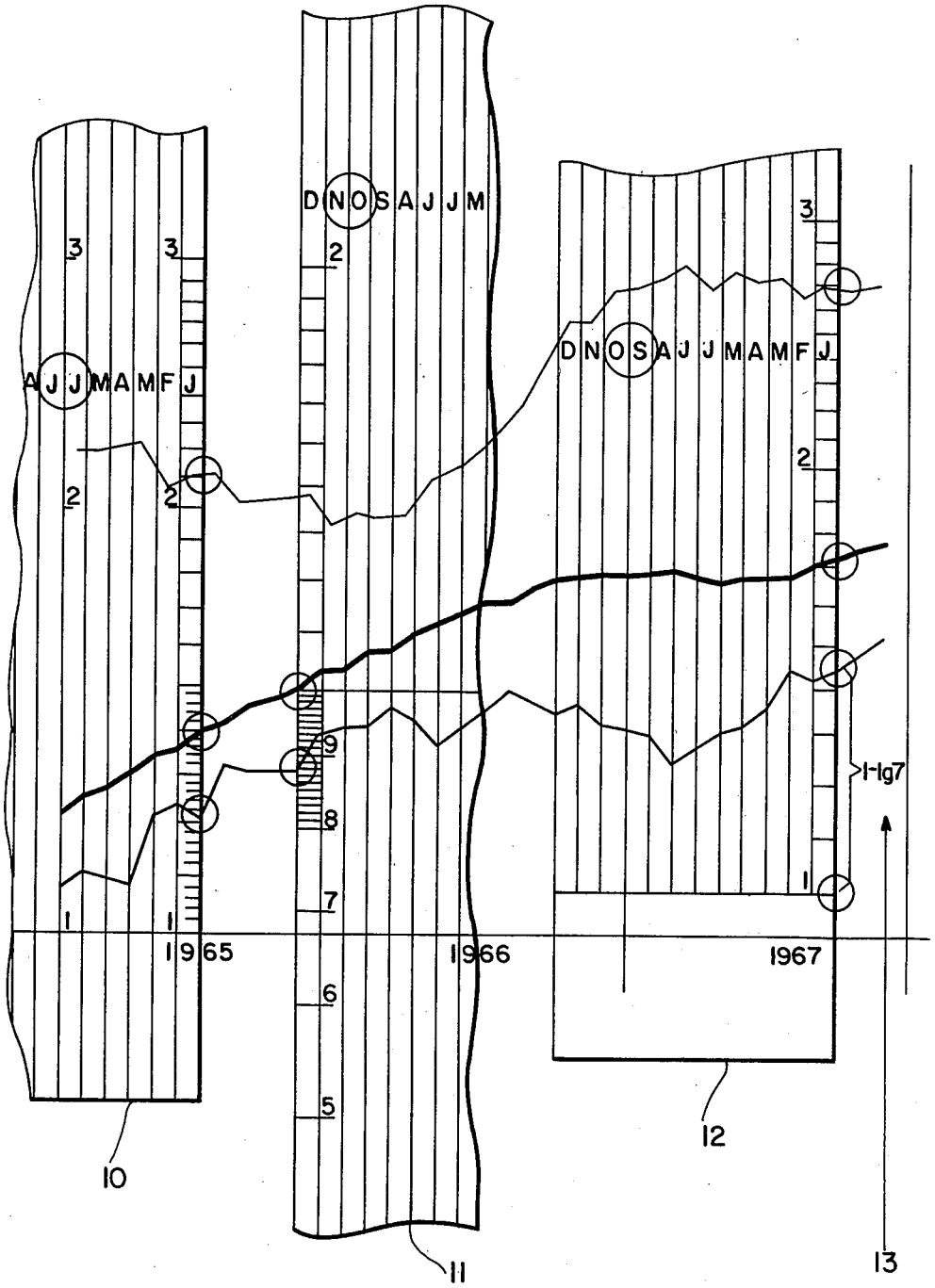
FIG. 4 illustrates three uses of the calculation ruler of FIG. 3 in relation to the curves of FIG. 1 so as to provide various information to the reader.

Referring to FIG. 4, three examples are shown wherein the calculating ruler of FIG. 3 is used in reading of the measuring values and their relationships. Three positions of the ruler relative to the curves 1, 2, 3, of FIG. 1 are shown. In the left-hand portion the ruler (which recognizable from the inverse month scale thereon and only a portion of which is illustrated) is positioned so as to permit reading of the June 1965 values. To accomplish this, the common baseline of the curves and the baseline of the calculating ruler (denoting the valve "1") are made to be congruent. In this mode of use, the values can be read directly at the intersection with the curves, as indicated by the small circles in the drawings.

In the middle portion of FIG. 4, the market share at the end of October 1965 is capable of being read. For this purpose the monthly division line on the inverse scale of months located between October and November is placed in alignment with the year-separating line between 1965 and 1966. Further, the baselne "1"of the ruler is aligned with the market development curve at the intersection between the two so as to provide a reference line. As can be seen from the drawings, the curve representing "ones own turnover" bisects the logarithmic scale at 8.8. Based on the scale values previously discussed, the corresponding market share at the time in question amounts to 8.8%.

The right-hand portion of FIG. 4 demonstrates how the calculating rule of the invention can be used in determining the time period it would take to sell the stock of finished goods at the end of September 1967 (as read from the inverse scale of the month indications), i.e., in calculating how long a supply of stored finished goods would last if production would stop and all further sales would be out of the supply on hand. The value for "our own turnover" is first recalculated from the price position "net" to "production costs" (share: 70%), by multiplying the turnover value by 0.7 with the help of the calculating ruler, i.e., by substracting 1−1 g 7. The new reference point is marked with the tip of a pencil and the baseline "1" of the calculating rule is aligned with this point. At the intersecting line with the curve indicating the "stock of finished goods," one then reads a range of time period of 2.7 months.

Figure 5:
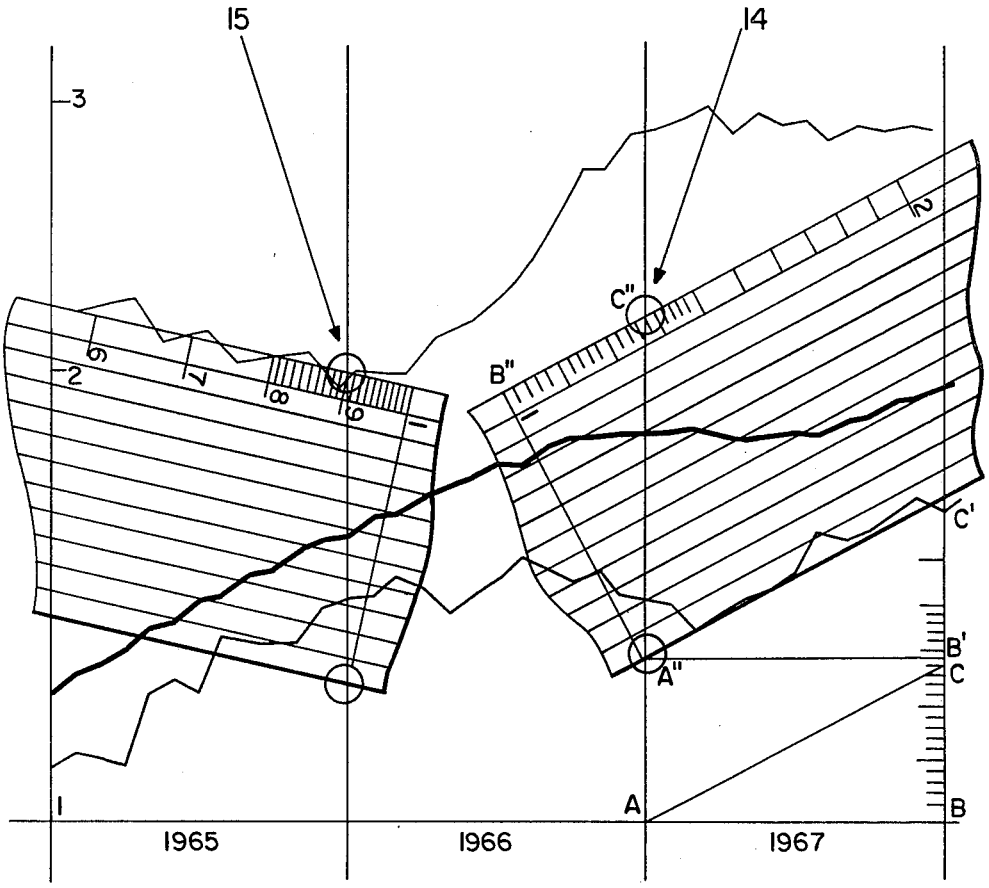
FIG. 5 illustrates a further way in which the calculation ruler of FIG. 3 can be used in extracting information from the curves of FIG. 1.

FIG. 5 demonstrates the use of the calculating ruler in determining growth rates. In this mode, one longitudinal edge of the calculating ruler is aligned with the "trend" of the curve, i.e., the average slope of the curve, and the terminal point A at the end of the baseline (see the left-hand portion of FIG. 5) is brought into congruence with the vertical line so that, at the point C, the growth rate per year is read. In the example shown at the right of FIG. 4, the growth rate is +28% per year, while in the example on the left, the rate is −10% per year. The mathematical foundation for the use of the calculating ruler in this mode is the geometrical relations between the triangles formed. Specifically, in the triangles $\overline{ABC}$, $\overline{A''B'C'}$ $\overline{A''B''C''}$, all angles of the triangles are equal and as a result of the unit yardstick and the common time scale, all lengths AB are equal. Thus, $\overline{BC}=\overline{B'C'}=\overline{B''C''}$.

Figure 6:
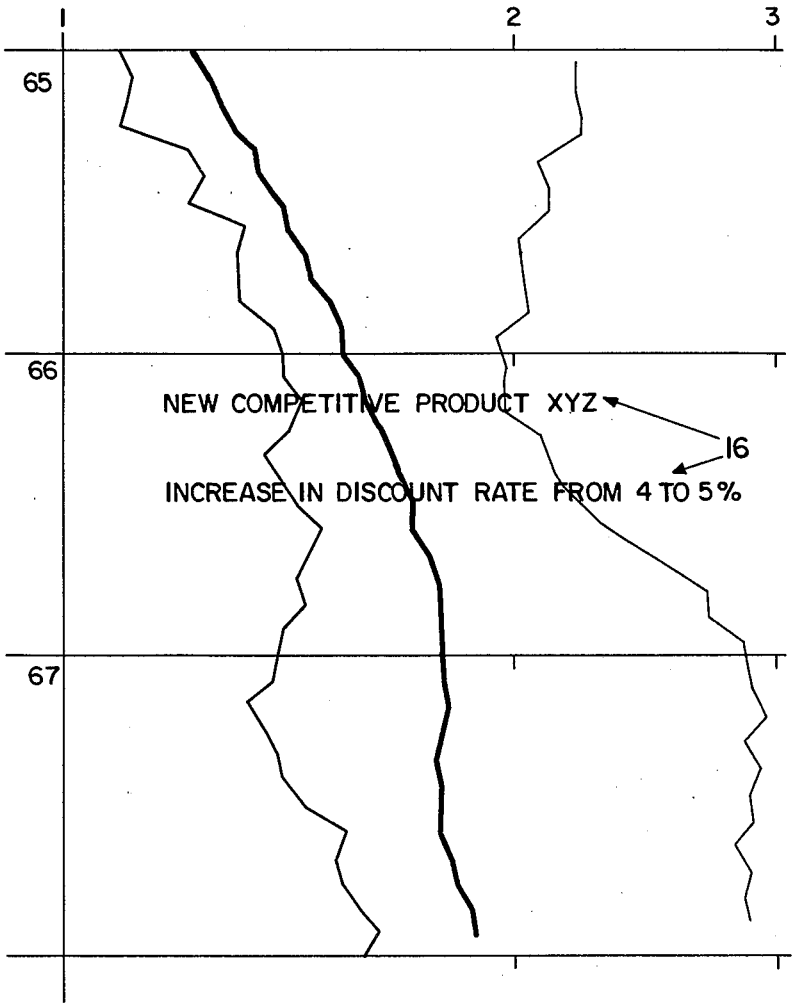
FIG. 6 is composite diagram illustrating a further aspect of the diagram analyzer of the invention.

Referring to FIG. 6, an exemplary embodiment of the diagram analyzer is shown for use in providing a reader with appropriate orientation relative to the curves of FIG. 1 so that an instant summary is provided of the measures taken (events) and the resultant effects. In order to present a compact overall picture of the situation, the information is arranged by means of a transparent information carrier on top of the curves that are to be evaluated. In order to produce an easily readable script, the height of the type, and the distance of the lines from one another, is doubled as compared with that shown in FIG. 2.

Although the invention has been described in relation to an exemplary embodiment thereof, it will be understood by those skilled in the art that variations and modifications can be effected in this exemplary embodiment without departing from the scope and spirit of the invention.

I claim:

1. A diagram analyzing device for use in assisting in visual understanding of curves plotted as a function of time according to a standard logarithmic scale, said device comprising a rectangular calculating ruler which is fabricated from a transparent material and which can be freely moved within the plane of the curves to reading positions relative to the curves to be evaluated, said ruler including, located at one of the two longitudinal sides thereof, at least one standard logarithmic scale and located transverse to said logarithmic scale at least one linear time scale corresponding to the time units used in the curves and providing time subdivisions disposed in parallel to the elongate sides of the calculating ruler.

2. A diagram analyzing device as claimed in claim 1, wherein the time scale subdivisions comprise marking lines extending parallel to the longitudinal sides of the calculating ruler, said marking lines occupying the coordinate system of the calculating ruler.

3. A diagram analyzing device as claimed in claim 1, wherein the middle of the time scale is marked.

4. A diagram analyzing device as claimed in claim 1, wherein the calculating ruler has at least one time scale with time values increasing from left to right.

5. A diagram analyzing device as claimed in claim 1, wherein said calculating ruler includes at least one time scale with an inverse sequence of time values providing for an increase in time from right to left.

6. A diagram analyzing device as claimed in claim 1, wherein the sequence of the time data provided the time scale of the calculating ruler comprises at least monthly data for least one full year.

7. A diagram analyzing device as claimed in claim 1, wherein the subdivisions of the time scale of the curves and time scale of the calculating ruler are adapted to the distances between lines provided by the printing technique used.

8. A diagram analyzing device as claimed in claim 1, wherein said calculating ruler includes at least one further time scale which provides a different measure of time and which is disposed at the baseline of the calculating ruler.

9. A diagram analyzing device as claimed in claim 1, further comprising an exchangeable table of events having information-bearing lines thereon, the positioning and spacing of which lines are directly related to time scale provided on the calculating ruler and curves.

10. A diagram analyzing device as claimed in claim 1, wherein the carrier on which the table of events is provided is transparent.

11. A diagram analyzing device as claimed in claim 10, wherein a common exchangeable carrier is provided for recording the curves to be combined.

12. A diagram analyzing device as claimed in claim 1, wherein at least two freely movable transparent diagram carriers are provided for the recording of the curves to be combined, said carriers lying within the plane of the curves and being exchangeable and alternatively superimposeable one upon the other.

13. A diagram analyzing device as claimed in claim 12 wherein the diagram carriers, the calculating ruler and the carrier of the table of events are in superimposed relation.

14. A diagram analyzing device as claimed in claim 1 wherein said ruler comprises a pair of said standard logarithmic scales marked off for a decade in unit values with the value "1" being indicated for each scale by a baseline extending across the entire width of the ruler.

15. A diagram analyzing device as claimed in claim 14 wherein the baseline for one of said scales is located at the lower end of the ruler and the baseline for the other scale is located in the middle of the ruler.

16. A diagram analyzing device as claimed in claim 14 wherein the baseline for one of said scales is located at the lower end of the ruler and the baseline for the other scale is located at the upper end of the ruler.

* * * * *